US007562620B1

(12) United States Patent
Nasiatka et al.

(10) Patent No.: US 7,562,620 B1
(45) Date of Patent: Jul. 21, 2009

(54) STRAPPING TOOL

(75) Inventors: Jason R. Nasiatka, Northbrook, IL (US); Janusz Figiel, Mundelein, IL (US); Ka Kuen Leung, Antioch, IL (US)

(73) Assignee: Illinois Tool Works, Inc., Glenview, IL (US)

( * ) Notice: Subject to any disclaimer, the term of this patent is extended or adjusted under 35 U.S.C. 154(b) by 0 days.

(21) Appl. No.: 12/352,213

(22) Filed: Jan. 12, 2009

Related U.S. Application Data

(60) Provisional application No. 61/024,710, filed on Jan. 30, 2008.

(51) Int. Cl.
*B65B 13/22* (2006.01)
*B65B 13/32* (2006.01)

(52) U.S. Cl. ..... 100/29; 100/32; 100/33 PB; 53/582; 53/590; 140/93.2; 156/73.5; 156/494; 156/502

(58) Field of Classification Search ..... 100/29, 100/30, 32, 33 R, 33 PB; 53/582, 590, 592; 140/93.2, 93.4; 156/73.5, 494–496, 502
See application file for complete search history.

(56) References Cited

U.S. PATENT DOCUMENTS 1,988,534 A * 1/1935 Abbott ..... 254/253
4,282,907 A * 8/1981 Massion et al. ..... 140/93.4
4,378,262 A * 3/1983 Annis, Jr. ..... 156/73.5
5,133,532 A * 7/1992 Figiel et al. ..... 254/216
5,954,899 A * 9/1999 Figiel et al. ..... 156/73.5
6,966,255 B1 * 11/2005 Crittenden ..... 100/29
7,438,094 B2 * 10/2008 Hillegonds et al. ..... 140/93.4

* cited by examiner

*Primary Examiner*—Jimmy T Nguyen
(74) *Attorney, Agent, or Firm*—Levenfeld Pearlstein, LLC

(57) ABSTRACT

A strapping tool for tensioning a strap around a load, adhering the strap onto itself, and cutting a feed end of the strap, includes a body having a foot on which the strap is disposed during a strapping cycle. The body housing and/or forming a part of a tensioning element and including a welding element. One or more pneumatic motors tension the strap and drive the welding element. A pneumatic module is mounted to the body. The module has a compressed gas inlet to the module and is configured for controlling the flow of compressed gas to the one or more motors. A handle is mounted to the body and operably connected to the pneumatic module. The handle is configured for manipulating the tool and includes an actuator for permitting and isolating the flow of compressed gas to the pneumatic module. The handle is orientable so as to allow a user to select a desired handle orientation for operation of the strapping tool. At least one hold-down finger is mounted at about the foot to temporarily hold the strap on the foot during tool operation.

7 Claims, 7 Drawing Sheets

STRAPPING TOOL

CROSS-REFERENCE TO RELATED APPLICATION DATA

This application claims the benefit of U.S. Provisional patent application Ser. No. 61/024,710, filed Jan. 30, 2008, incorporated herein by reference.

BACKGROUND OF THE INVENTION

The present invention pertains to an improved, hand-held pneumatic strapping tool. Strapping tools are well-known in the art. These tools come in a wide variety of types, from fully manual tools to automatic, table-top tools. Tools are generally designed for use with either metal strapping or plastic/polymeric strapping.

Hand-held pneumatic (plastic) strapping tools are commonly used in the field, in manufacturing facilities and the like for on-the-spot application of strapping material to a load.

Powered or driven tools are usually either electrically or pneumatically driven. This is necessary in order to provide energy for tensioning the strapping material and adhering the strap onto itself. Typically, the adhering function is provided by melting or otherwise welding a section of the polymeric (plastic) strapping material onto itself. Examples of such tools are disclosed in Rometty et al., U.S. Pat. No. 6,732,638, Crittenden, U.S. Pat. No. 6,966,255 and Nasiatka et al., U.S. Pat. No. 7,155,885, all of which are commonly assigned with the present application and invention and all of which are incorporated herein by reference.

In certain applications, the strapper is used in a vertical orientation rather than a horizontal orientation. As such, the strapper may be awkward to use, while trying to position and secure strap within the sealing jaws or sealing region, and while attempting to operate the strapping tool.

It has also been observed that after a strap seal is formed, the leading end (the cut end) of the strap can fall from the strapper, which requires the operator to retrieve the strap and refeed it into the strapper to commence a subsequent strapping operation.

Accordingly, there is a need for a pneumatic strapping tool that secures the strap material in the tool during and following strapping operations. Desirably, such a tool is configured for ergonomic use in a vertical orientation as well as the (conventional) horizontal orientation. More desirably, such an ergonomic design facilitates operation in the vertical (and horizontal) orientations.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
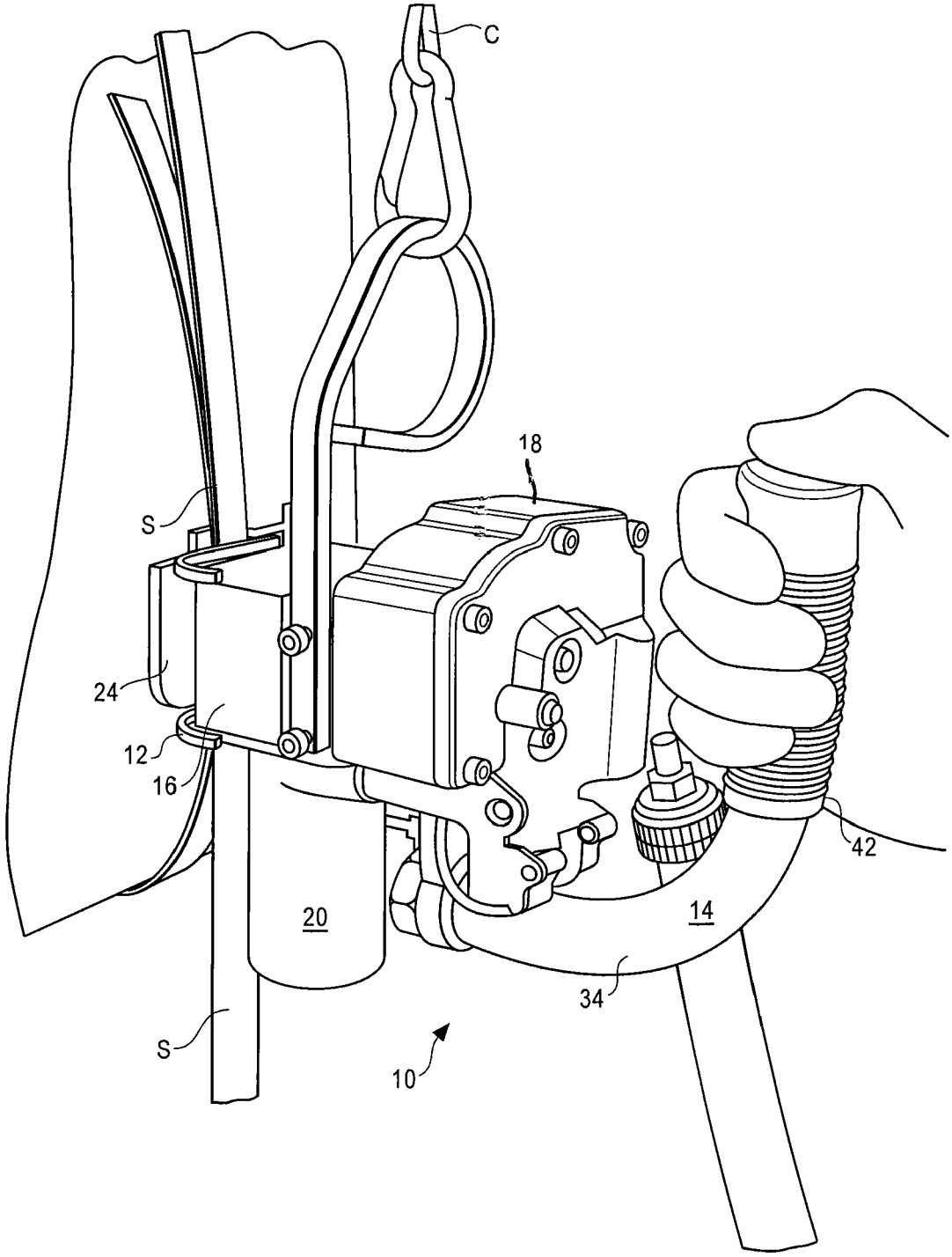
FIG. 1 is a perspective view of an improved strapper with strap hold-down fingers and an ergonomic handle-integrated pneumatic actuator embodying the principles of the present invention, the strapper shown with an operator's hand on the handle.
Figure 2:
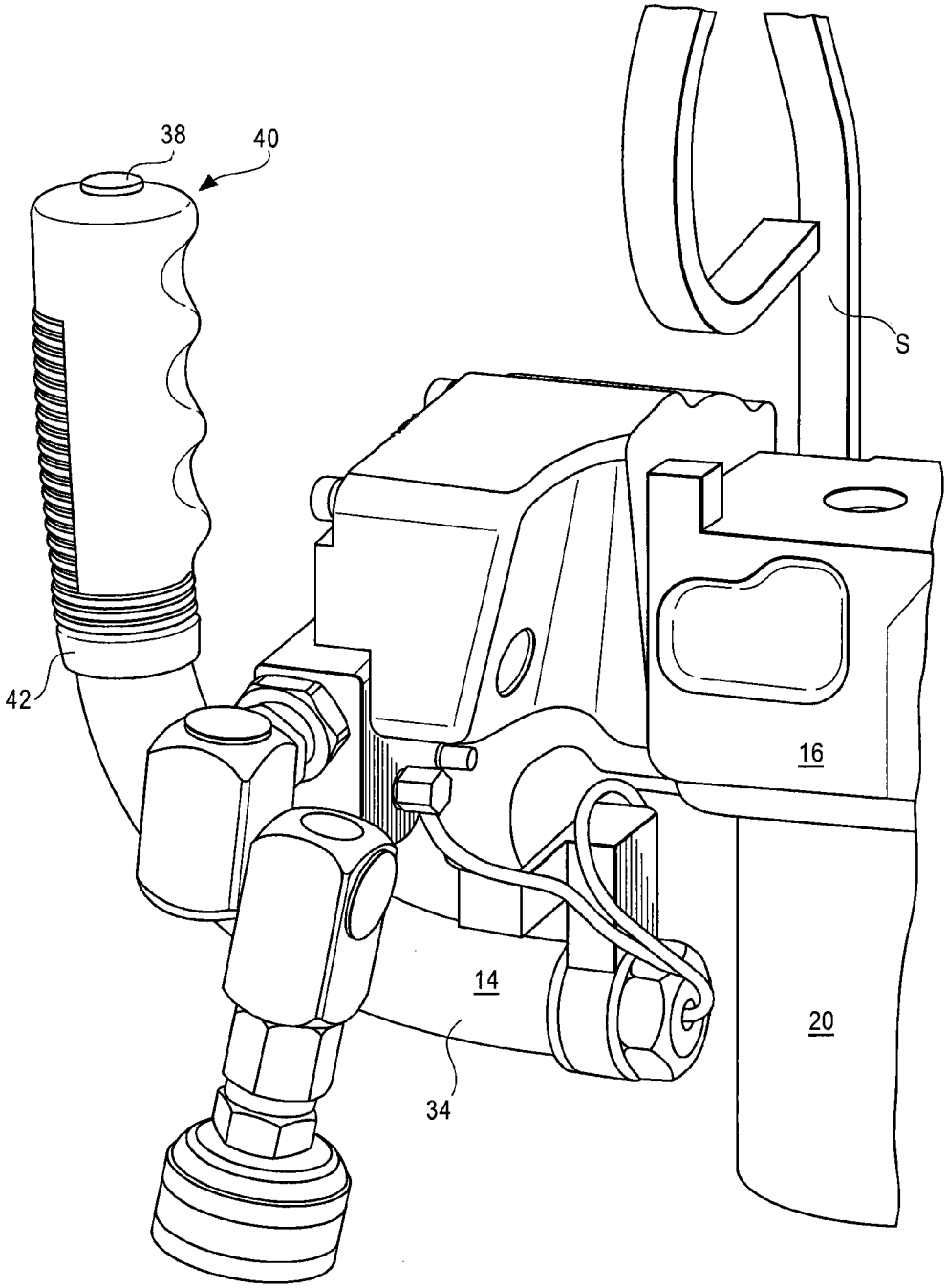
FIG. 2 is a perspective view of the present invention showing the handle and the actuator switch (button) located on the handle.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description Of The Invention", relates to a requirement of the United States Patent Office, and does not imply, nor should be inferred to limit the subject matter disclosed herein.

Referring now to the figures and in particular to FIG. 1, there is shown a strapping tool 10, having hold-down fingers 12 and an ergonomic, pneumatic actuator integrated handle 14, embodying the principles of the present invention.

The strapping tool 10 includes, generally, a body 16 that encloses the tool components to tension, seal, and cut the strap S. A pneumatic module 18 is part of the tool 10 and is mounted to the body 16. The tool 10 is operated by pneumatic pressure supplied by an outside source. One or more pneumatic motors 20 function to tension the strap S and seal a course of the strap S onto another course of the strap S. During the sealing operation, the strap S is held between an anvil 22, located on the foot 24 of the tool 10 and a weld pad 26 that is spaced from the anvil 22. A cutter (not shown) is also disposed at about the weld pad 26 to sever the strap S from the strap S supply so the looped portion of the strap S is freed from the source.

When the tool 10 is used, the cut end of the strap S typically slips from the tool 10. This requires an operator to pick up the strap from the floor and reposition the strap S in the tool, create a loop of strap S around the load and tighten the strap S before commencing the strapping (sealing) cycle.

Figure 3:
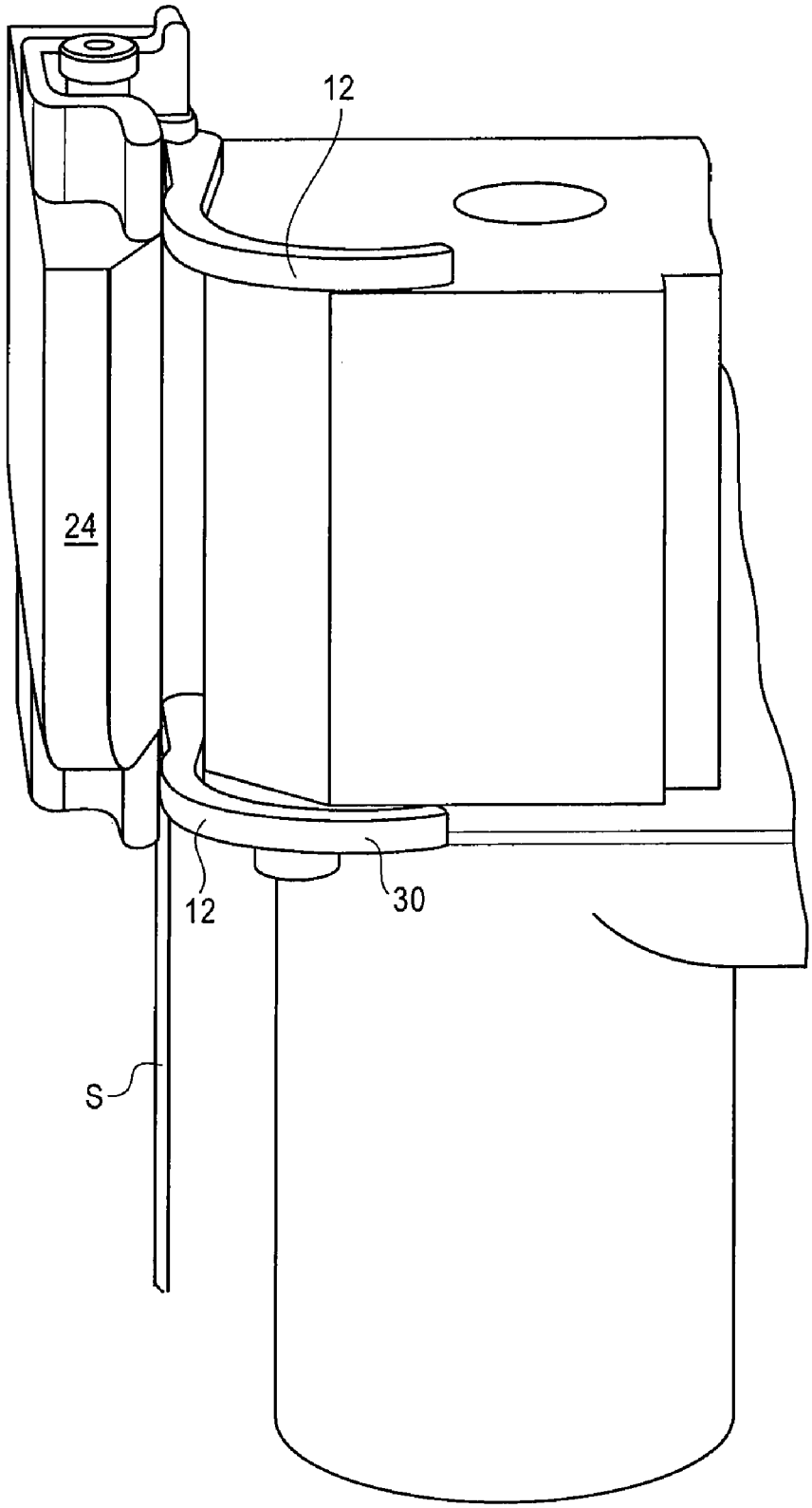
FIG. 3 is a perspective view of the foot of the tool and the hold-down fingers mounted on the sides of the foot.
Figure 4:
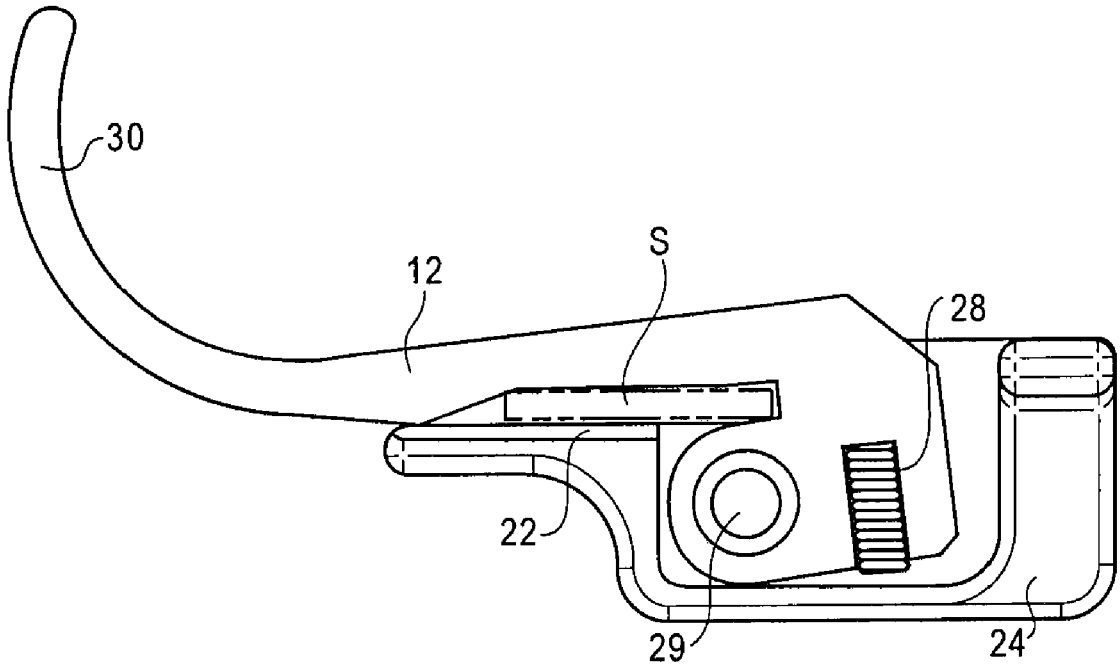
FIG. 4 is a side view of the hold-down finger.
Figure 5:
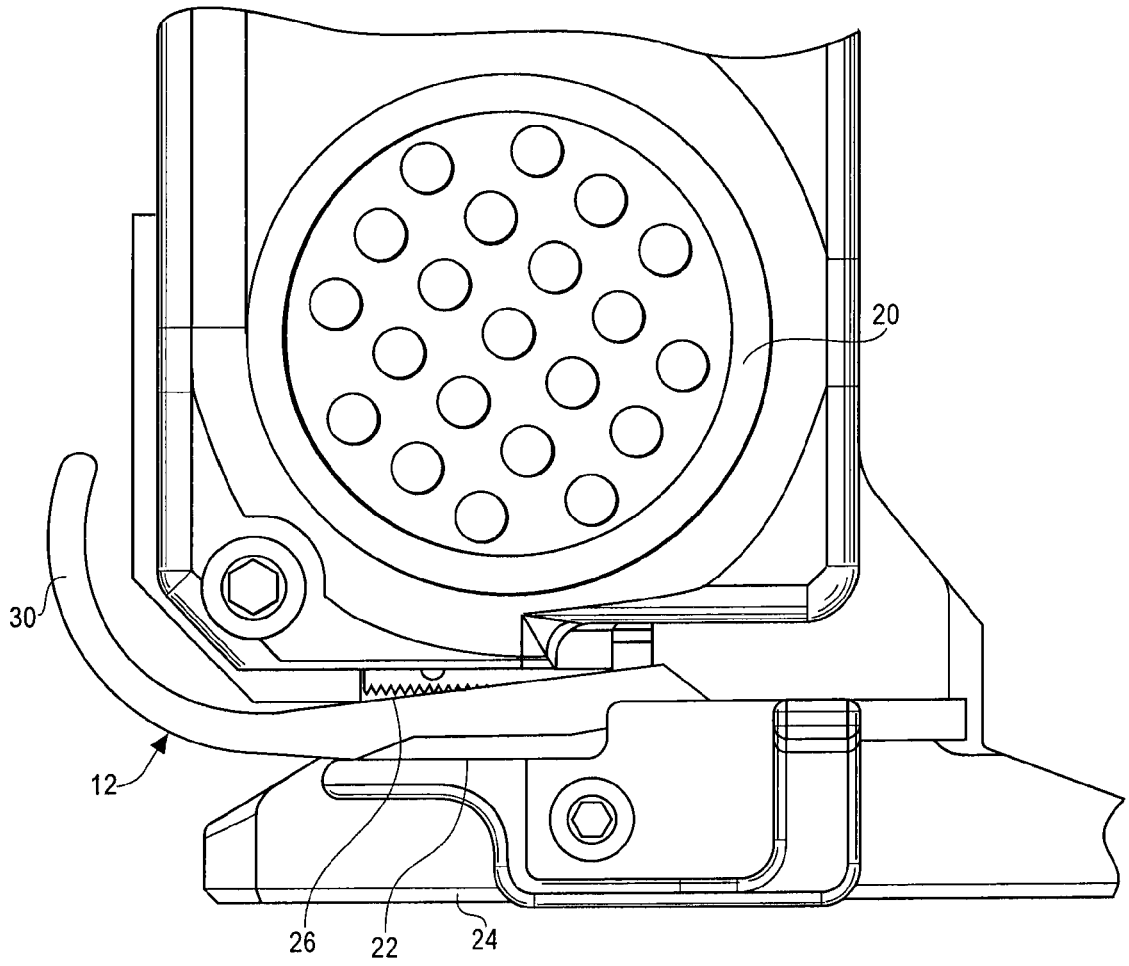
FIG. 5 is another side view of the finger shown as mounted to the tool.
Figure 6:
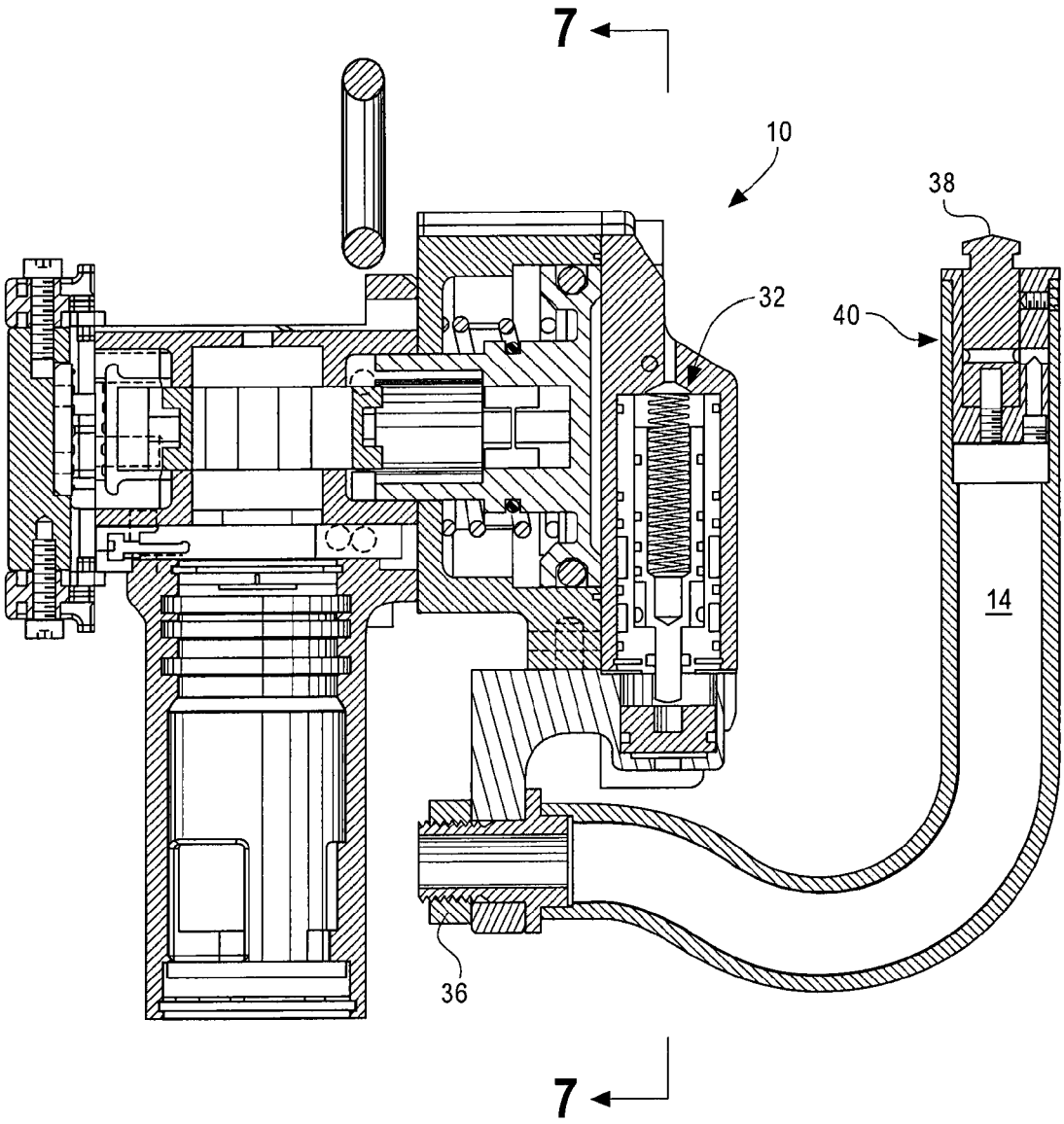
FIG. 6 is across-sectional view of the pneumatic system and integrated ergonomic actuating handle.
Figure 7:
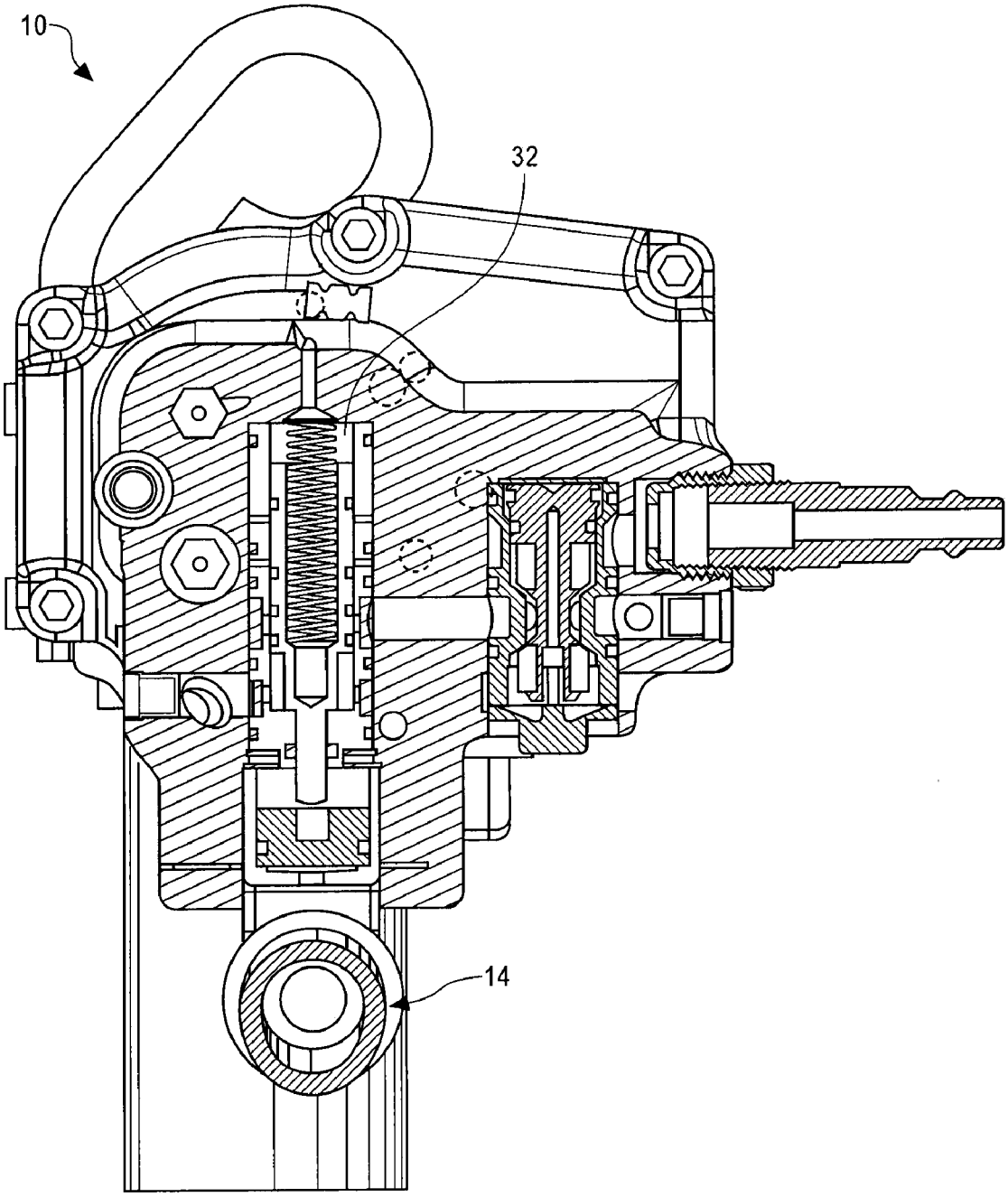
FIG. 7 is another cross-sectional view of the pneumatic system and integrated ergonomic actuating handle taken at 90 degrees to that shown in FIG. 6.

The present tool 10 includes hold-down fingers 12 disposed on each side of a foot 24 (enveloping the weld pad 26/anvil 22 and cutter). The hold-down fingers 12 are biased (as by a spring 28) to a closed position, that is, to hold down the strap S. As can be seen in FIGS. 3-5 the strap S is positioned under the hold-down finger 12 (between the hold-down finger 12 and the foot 24), and is maintained in place by the spring force acting on the hold-down finger 12. The strap S can be slid, transversely across the hold-down finger 12 and longitudinally along the hold-down finger 12. The hold-down finger 12 is intended to prevent the strap S from slipping from the foot, not to rigidly lock the strap S in place. The hold-down fingers 12 have curved free ends 30 to facilitate readily slipping the strap S under the hold-down fingers 12, without undue effort.

The hold-down fingers 12 pivot about a pin 29 that mount the hold-down fingers 12 to the foot 24. The pin 29 can be located between the spring 28 and the curved free end so that the spring 28 is not in the strap path—that is, out of the way of the strap in the strapper.

As seen in FIGS. 1, 2, 6, and 7, the tool 10 has an ergonomic handle 14 that is integrated into the pneumatic system 32. The handle 14 is configured having a curved shape (as indicated at 34) so the operator can position his or her hand on the handle 14 with their hand (their fingers) oriented in a vertical plane. It has been found that it is easiest to manipulate the tool 10 and most comfortable to use the tool 10 with the user's hand in the vertical plane (as seen in FIG. 1). However, the handle 14 can be rotated (see adjusting nut 36) to any orientation to meet a desired orientation.

Known pneumatic strapping tools have actuation levers, switches or buttons located on the tool, generally on the tool body or on the pneumatic module to commence the strapping (welding) cycle. While this functions perfectly well for most strapping tools and specifically for tools used in a horizontal orientation, it may not be especially ergonomically efficient for tools that are used in a vertical orientation. Accordingly, in the present strapping tool 10 the handle 14 is integrated into the pneumatic system 32 with an actuator button or switch 38 located on the end 40 of the handle 14. In this manner, as seen in FIG. 1, the operator holds the handle 14 (gripping portion 42) in his or her hand, with their fingers wrapped around the gripping portion and with their thumb resting on the actuator switch 38. In this manner, the strapping tool 10 can be manipulated and operated with one hand while, for example, the strapping tool 10 is suspended from a cable C or the like. The integrated handle 14 is configured such that the actuator switch (button) 38 is formed as part of a pneumatic switch or plunger (piston) within the pneumatic circuit.

It will be appreciated that although the present hold-down fingers 12 and ergonomic handle 14 (integrated into the pneumatic system) are shown on a strapping tool 10 having only a welding or sealing function, it will be appreciated that the present strapping tool 10 can be used on any of a wide variety of strapping tools, including full-function tools (e.g., those having a tensioning cycle as well), which strapping tools are within the scope and spirit of the present invention.

All patents referred to herein, are hereby incorporated herein by reference, whether or not specifically do so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A strapping tool for tensioning a strap around a load, adhering the strap onto itself, and cutting a feed end of the strap, comprising:

a body having a foot on which the strap is disposed during a strapping cycle, the body housing a tensioning element and a welding element;

one or more pneumatic motors for tensioning the strap and for driving the welding element;

a pneumatic module mounted to the body having a compressed gas inlet to the module and configured for controlling the flow of compressed gas to the one or more motors;

an adjustable handle mounted to the body and operably connected to the pneumatic module; and two biased hold-down fingers pivotally mounted at about the foot to temporarily hold the strap on the foot during and following strapping operation, each of the hold-down fingers having a curved free end, the free ends are curved upwardly to facilitate readily slipping the strap under the hold down fingers without undue effort, the hold-down fingers are disposed on opposing sides of the foot, the hold-down fingers are disposed on opposing sides of the tensioning and welding elements, wherein the hold-down fingers are configured to prevent the strap from slipping from the foot, not to rigidly lock the strap in place.

2. The strapping tool for tensioning a strap around a load in accordance with claim 1 including a biasing element and wherein the hold-down fingers are biased toward the foot, to a closed position.

3. The strapping tool for tensioning a strap around a load in accordance with claim 1, wherein the hold-down fingers pivot about a pin.

4. The strapping tool for tensioning a strap around a load in accordance with claim 2 wherein the hold-down fingers pivot about a pin and wherein the pin is located between the biasing element and the free end.

5. The strapping tool for tensioning a strap around a load in accordance with claim 1, wherein the handle is configured for manipulating the tool, the handle including an actuator for permitting and isolating the flow of compressed gas to the pneumatic module.

6. The strapping tool for tensioning a strap around a load in accordance with claim 5 wherein the actuator is located at an end of the handle.

7. The strapping tool for tensioning a strap around a load in accordance with claim 5, wherein the handle is orientable so as to allow a user to select a desired handle orientation for tool operation.

* * * * *